US009188138B2

(12) United States Patent
Keegan et al.

(10) Patent No.: US 9,188,138 B2
(45) Date of Patent: Nov. 17, 2015

(54) DEVICE FOR ADJUSTING VARIABLE GUIDE VANES

(75) Inventors: Colm Keegan, Nettleham (GB); Michael Tibenham, Washingborough (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 660 days.

(21) Appl. No.: 13/521,472

(22) PCT Filed: Nov. 17, 2010

(86) PCT No.: PCT/EP2010/067656

§ 371 (c)(1), (2), (4) Date: Sep. 26, 2012

(87) PCT Pub. No.: WO2011/091881

PCT Pub. Date: Aug. 4, 2011

(65) Prior Publication Data

US 2013/0058763 A1 Mar. 7, 2013

(30) Foreign Application Priority Data

Jan. 28, 2010 (EP) ..... 10000879

(51) Int. Cl.
*F04D 29/56* (2006.01)
*F01D 17/16* (2006.01)

(52) U.S. Cl.
CPC ..... *F04D 29/563* (2013.01); *F01D 17/162* (2013.01); *F05D 2260/79* (2013.01)

(58) Field of Classification Search
None
See application file for complete search history.

(56) References Cited

U.S. PATENT DOCUMENTS

| | | | | |
|---|---|---|---|---|
| 3,487,992 | A | 1/1970 | Pineda | |
| 6,551,057 | B1 | 4/2003 | Bowen | |
| 8,435,000 | B2 * | 5/2013 | Wong et al. | 415/161 |

FOREIGN PATENT DOCUMENTS

| | | | |
|---|---|---|---|
| DE | 1805942 | A1 | 6/1969 |
| EP | 1101902 | A2 | 5/2001 |
| EP | 2136036 | A1 | 12/2009 |
| RU | 2098670 | | 12/1997 |

* cited by examiner

*Primary Examiner* — Christopher Verdier
*Assistant Examiner* — Justin Seabe

(57) ABSTRACT

A device for adjusting variable guide vanes of an axial-flow machine includes a control rod that adjusts an angular position of the variable guide vanes and is pivotably connected to a shaft. Each of a first and a second bracket has a first end connectable to a casing of the machine. A first joint is fixed to a second end of the first bracket and provides adjustable positioning of a first end of the shaft. A second joint is fixed to a second end of the second bracket and provides adjustable positioning of a second end of the shaft. The two joints are spatially positioned to each other solely via a first fixed connection between the first end of the first bracket to the casing and via a second fixed connection between the first end of the second bracket to the casing.

7 Claims, 4 Drawing Sheets

DEVICE FOR ADJUSTING VARIABLE GUIDE VANES

CROSS REFERENCE TO RELATED APPLICATIONS

This application is the US National Stage of International Application No. PCT/EP2010/067656, filed Nov. 17, 2010 and claims the benefit thereof. The International Application claims the benefits of European application No. 10000879.6 EP filed Jan. 28, 2010. All of the applications are incorporated by reference herein in their entirety.

FIELD OF THE INVENTION

The invention relates to a device for adjusting variable guide vanes, a compressor and a gas turbine engine including such a device.

BACKGROUND OF THE INVENTION

A gas turbine engine comprises a turbine and a compressor driven by the turbine, the compressor may be of an axial flow type. Commonly, the gas turbine engine is subjected to varying operating conditions resulting in different aerodynamic flow conditions within the compressor. In order to adapt the compressor performance to different operating demands, it is known to provide the compressor with variable guide vanes (VGV). The variable guide vanes are to be pivoted about their longitudinal axis in order to adjust their angle of attack.

Each variable guide vane is provided with a journal at its root, wherein the journal is pivot-mounted in a through hole in the compressor casing. The journal is accessible from outside the compressor casing and comprises a lever to be actuated for pivoting the variable guide vane. All levers may typically be coupled by means of a unison ring arranged concentrically around the compressor casing. The rotation of the unison ring actuates each of the variable guide vane levers of one stage simultaneously to achieve a corresponding rotational setting of each variable guide vane within the compressor casing.

An axial compressor consists of multiple stages of stator vanes and rotor blades. The front stages of stator vanes often have variable pitch to control the flow. Flow control is important on engine run up to avoid surge. Variable guide vanes of different stages may be pivoted by different angles.

It is known—and also shown in FIGS. 1 and 2—that individual vane pitch or angular offset is controlled via a linkage mechanism comprising vanes 10, 11 mounted on spindles 22 to allow angular movement of the vane 10, 11 and levers 20 for connecting the spindles 22 to a driving ring 40, 41, 42, 43, the so called unison ring, wherein all vanes 10, 11 in a single stage connecting to the same ring. Each ring is rotated via a control rod 50 from a common shaft 61. The shaft 61 may be rotated via a hydraulic ram 60 and may be fixed rotably via bearings. All mentioned reference signs relate to the FIGS. 1 and 2.

To attach this mechanism to the casing of the compressor with the required stability, an implementation is known (see also FIG. 3), in which a longitudinal beam 90 possibly with welded mountings at its ends, is bolted to bearings 80, 81 for the shaft 61 and bolted to brackets 70, 71, the brackets 70, 71 being bolted to the compressor casing 2. This provides a good stability but may have disadvantages in regards of manufacturing costs and of fatigue of welds. Furthermore a relative thermal expansion of the casing 2 has to be accommodated. This may be possible by allowing flexing of one the brackets 71. This flexibility is indicated in FIG. 3 by showing a lesser width of the bracket 71 compared to the other bracket 70.

According to EP 1 101 902 A2, a torque shaft assembly includes a hollow tube with a central axis disposed between and fixedly connected to first and second crankshafts at first and second distal ends. This shaft specifically is adapted to vibrations of the engine during operation, as a hollow interior of tube between the first and second crankshafts is filled with a sufficient quantity of flowable inertia material or damping media to absorb vibratory energy by friction during operation of the engine. The shaft may provide the needed stiffness such that an additional beam between the first and the second distal ends is not necessary. The first end shaft is rotatably supported by a first shaft bearing which is preferably a lined journal bearing type. The second end shaft is rotatably supported by a second shaft bearing which is preferably a spherical bearing.

In EP 2 136 036 A1 a crank shaft is disclosed that is comprised of first and second crankshafts and a torsion bar connected to both crankshafts. An additional longitudinal beam, as discussed above, is not part of this control mechanism.

According to DE 18 05 942 A1, a crank shaft is disclosed with two studs for which "self-adjusting" bearings may be provided to allow easy assembly.

SUMMARY OF THE INVENTION

The present invention seeks to mitigate these drawbacks.

This objective is achieved by the independent claims. The dependent claims describe advantageous developments and modifications of the invention.

In accordance with the invention there is provided a device for adjusting variable guide vanes of an axial-flow machine, for example of a gas turbine engine or an industrial compressor. Preferably the device may be a part of a compressor. The device comprises at least one control rod for adjusting an angular position of the variable guide vanes and a rotatable shaft to which the at least one control rod is pivotably connected. Furthermore the device comprises a first bracket and a second bracket, each having a first end connectable to a casing of the axial-flow machine. A first joint is fixed to a second end of the first bracket and provides adjustable positioning of a first end of the shaft. A second joint is fixed to a second end of the second bracket and provides adjustable positioning of a second end of the shaft. According to the invention the first joint and the second joint are spatially positioned to each other solely via a first fixed connection between the first end of the first bracket to the casing of the axial-flow machine and via a second fixed connection between the first end of the second bracket to the casing of the axial-flow machine. Furthermore, the first joint and the second joint is a ball-joint and a sliding pin-joint and wherein the shaft represents a pin of the sliding pin-joint, which slides in a ball of the ball-joint during an axial adjustment in an axial direction.

Thus, the respective joint is a combined or integral ball-joint and sliding pin-joint. The combined ball-joint and sliding pin-joint may provide adjustments for both axial and rotational movements in one single piece.

Structural stability is provided by a stiff casing, so that an additional stabilising beam as can be seen in FIG. 3 (see reference sign 90) can be omitted (see FIG. 4). By omitting the beam a further problem can be excluded which takes place due to thermal expansion of the casing and having no thermal expansion of the beam. Thus mechanical stresses and fatigue used to appear due to the beam, especially in the brackets and its fixation or in welds. This is avoided according to the invention because of the adjustable positioning of the ends of the shaft, so that thermal expansion of the casing will lead to a greater distance of the brackets to each other without resulting in mechanical stress in the shaft or the brackets, because the joints allow adjustable positioning of the shaft, e.g. by sliding to a different position at the shaft.

The invention specifically applies to devices in which the at least one control rod is adjusting the angular position of the variable guide vanes mechanically.

Like a bell crank, the rotatable shaft provides a rotation around an axis which is substantially parallel to the main air flow through a compressor, to which the device may be attached. The rotation of the shaft may affect also a rotation of arms or levers attached to the shaft and finally resulting in a longitudinal movement of the at least one control rod, which may be connected to the arm via a ball joint, heim joint or rose joint. The one control rod may be connected to a driving ring around a compressor and the movement of the control rod will lead to a turning motion of the driving ring that eventually will cause variable guide vanes to be turned.

According to the invention, the casing may be a casing of a compressor or may also be an overall casing of the axial-flow machine, as long it provides a sufficient mechanical support for the device.

According to the invention the first joint and the second joint are spatially positioned to each other solely via a first fixed connection between the first end of the first bracket to the casing of the axial-flow machine and via a second fixed connection between the first end of the second bracket to the casing of the axial-flow machine. Specifically, the first joint and the second joint may be spaced apart strutless via the first bracket, the casing and the second bracket, particularly by omitting a stabilising beam for interconnecting the two joints.

According to the invention the first joint and the second joint is a ball-joint and a sliding pin-joint. The pin-joint may allow for adaption a higher thermal expansion of the casing compared to no or lesser thermal expansion of the shaft. The pin-joint allows that the distance of the first joint and the second joint can vary based on the expansion of the casing. The ball-joint may allow the rotation of the shaft.

The adaption to a larger distance between the first and the second joint, i.e. the adjustable positioning of the ends of the shaft, may additionally be supported by not having a restraining device, wherein the restraining device limits movements of the shaft in an axial direction of the shaft, e.g. a limiting latch or a similar construction at the ends of the shaft that would limit the joints in their divergent movement, so that thermal expansion of the casing will be approximately matched by a similar divergent movement of the joints. Possibly this may be possible if the first end and/or the second end of the shaft will have an unvaried diameter or the diameters even reduce in direction of the head ends of the shaft. A restraining device is particularly a part of the shaft or a piece attached to the shaft that may limit movements of the shaft in axial direction of the shaft.

The axial position of the shaft may be controlled by contact of shaft shoulders of the shaft with either bracket or either joint. So there may be a clearance which allows a small amount of axial movement, such that there is a small clearance when assembled, and a larger clearance when running, due to thermal expansion of the casing.

It may be possible as an alternative to constrain the shaft axially in both directions at the upstream bracket, for example by adding a circlip to the shaft extension upstream of one of the joints. This allows to not have an axial constraint by means of linkages. During operation, the shaft may run in the middle, without contacting the brackets, but it may be possible that the shaft is run in contact with one of the brackets.

Advantageously the first bracket and/or the second bracket may be cast. This may provide a strong stiffness if the cast body has a sufficient thickness and allows cheap manufacturing. Welds may be superfluous in the cast brackets which again removes a potential cause of fatigue failure and removes the costs of having to ensure weld quality.

In a further preferred embodiment the first bracket and/or the second bracket may be substantially inflexible such that lateral movements of the first end of the respective bracket in regards to the second end of the respective bracket may be prohibited. This inflexibility can be reached by casting the brackets, possibly resulting in a body with specific structure that supports the stiffness, and by building thick walls to gain the required stiffness.

In yet another preferred embodiment the connection of the first end of the first bracket and/or the first end of the second bracket to the casing may be realised by bolting. The brackets may be bolted individually to the casing. This is possible because no beam is existing that requires to have two mountings aligned simultaneously.

Besides the aforementioned device for adjusting variable guide vanes, the invention is also directed to a compressor and a gas turbine engine that comprise such a device.

It has to be noted that in this document the term "variable guide vanes" should not be limited only to inlet guide vanes which are upstream of the first stage of rotor blades. Also variable stator blades, which are immediately downstream of their respective rows of rotor blades, are considered "variable guide vanes" in this context.

It has to be noted that embodiments of the invention have been described with reference to different subject matters. In particular, some embodiments have been described with reference to apparatus type claims whereas other embodiments may have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

The aspects defined above and further aspects of the present invention are apparent from the examples of embodiment to be described hereinafter and are explained with reference to the examples of embodiment.

BRIEF DESCRIPTION OF THE DRAWINGS

Embodiments of the invention will now be described, by way of example only, with reference to the accompanying drawings, of which.

The illustration in the drawing is schematical. It is noted that for similar or identical elements in different figures, the same reference signs will be used.

Some of the features and especially the advantages will be explained for an assembled gas turbine, but obviously the features can be applied also to the single components of the gas turbine but may show the advantages only once assembled and during operation. But when explained by means of a gas turbine during operation none of the details should be limited to a gas turbine while in operation.

DETAILED DESCRIPTION OF THE INVENTION

The invention may particularly be applied to a gas turbine engine that can generally include a compressor section 1 (see FIG. 2), a combustor section (not shown) and a turbine section (not shown). A centrally disposed rotor (not shown) can extend through these three sections. The compressor section 1 can include alternating rows of vanes 10, 11, . . . and rotating blades (not shown).

The invention is directed to a compressor with "Variable Guide Vanes" (VGV). This is a construction with variable pitch of the stator vanes 10, 11, . . . .

Figure 1:
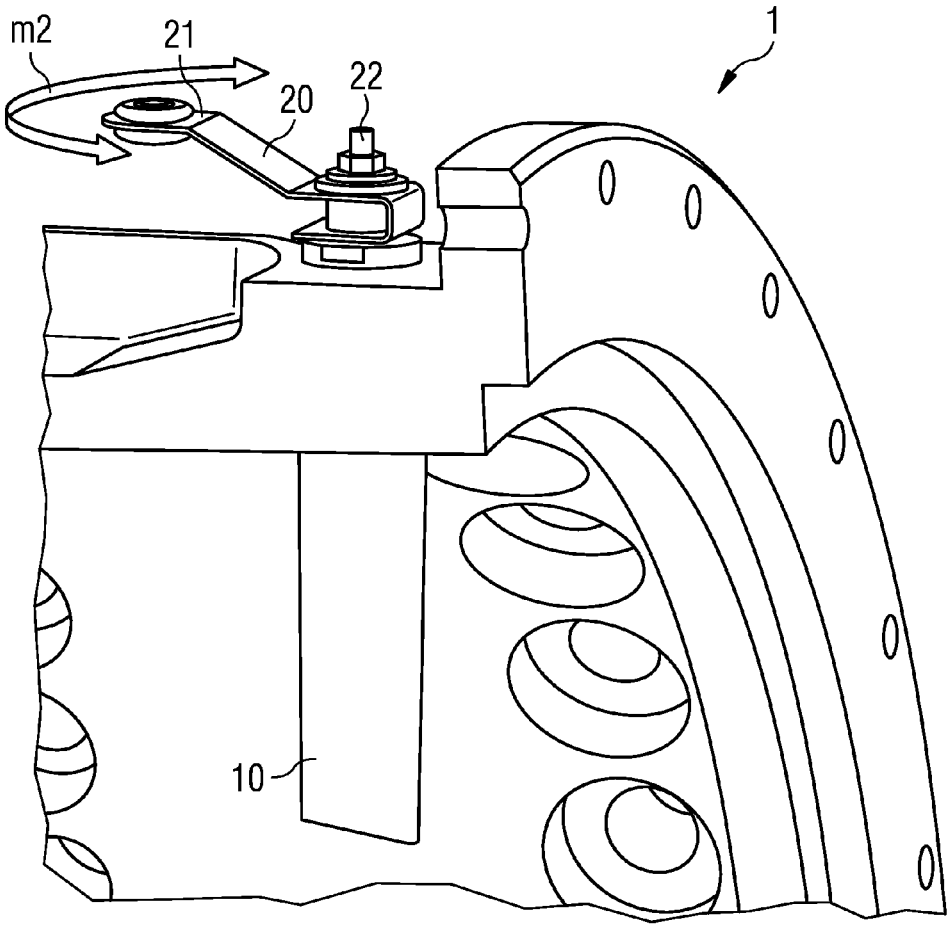
FIG 1 PRIOR ART
FIG. 1: is a part of a perspective view of a known compressor stage of a turbine engine.
Figure 2:
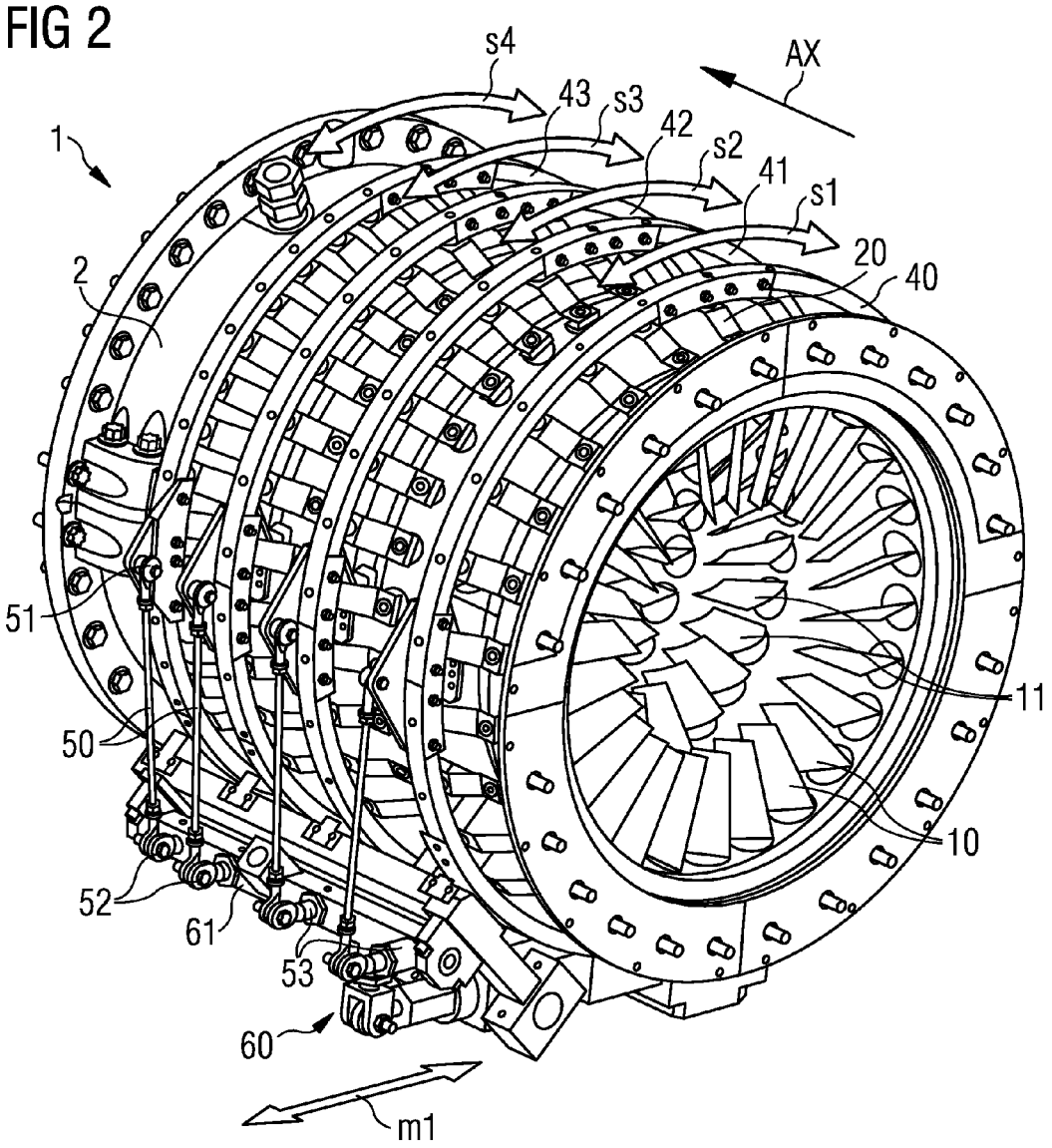
FIG. 2: is a perspective view of a compressor of a known turbine engine.
Figure 3:
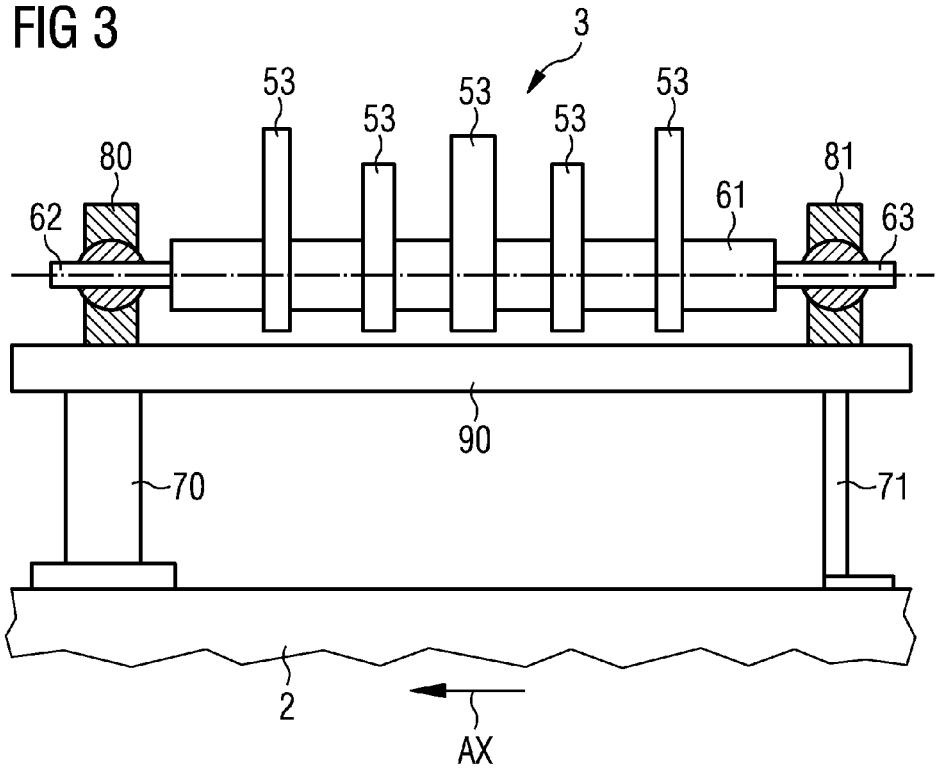
FIG. 3: is a view of a prior art device for adjusting pitch of variable guide vanes.

Based on FIGS. 1, 2, and 3 the general concept of "Variable Guide Vanes" is explained. These concepts also apply to the invention. Differences to the invention will be explained later, in regards of FIG. 4.

The pitch or the angular offset for an individual stage of variable guide vanes inside of the compressor wall is controlled via a linkage mechanism which is applied from the outside of the wall. Each individual first stage guide vane 10, second stage guide vane 11, . . . is mounted on a spindle 22 or has a spindle 22 at its radial outward end to allow angular movement of the vane 10, 11. A short lever 20 connects the spindle 22 to a driving ring 40, 41, 42, 43 as adjustment ring, the so called unison ring. All vanes 10, 11, . . . in a single stage are connected to the same ring so that all vanes 10, 11, . . . on one stage are adjusted at the same time and with the same angle. FIG. 1 shows specifically the individual vane 10 of the first stage—e.g. the most upstream stage of the compressor—and its corresponding lever 20. FIG. 2 shows an overall view of a compressor that shows a complete stage of vanes 10 of the first stage.

Each lever 20 has a connecting piece 21 that links the lever 20 to the corresponding driving ring 40, 41, 42, 43. Each of the driving rings 40, 41, 42, 43 is rotated via a control rod 50—one per ring—from a common bell crank or rotatable shaft 61.

The basic mechanism is as follows: A ram drive 60—possibly hydraulic or electric—will be laterally moved (indicated by arrow m1). This lateral movement results in a turning of the rotatable shaft 61. The rotatable shaft 61 may have different arms 53 with different lengths, one per stage of vanes. At the arms 53 the control rods 50 are attached. Therefore a rotating movement of the rotatable shaft 61 is directly applied to the control rods 50 providing a lateral movement—compared to the axial direction AX of the compressor which is also defining a flow direction of air there through—of the control rods 50. The other end of the control rods 50 is attached to the driving rings 40, 41, 42, 43 so that the lateral movement of the control rods 50 directly forces the driving rings 40, 41, 42, 43 to execute a rotational movement as indicated by the arrows s1, s2, s3, s4. Due to the different length of arms, the rotational movement may be different such as one ring may turn less than another one.

With the use of a single ram drive 60 the angular position during ram travel is proportional stage to stage.

The rotational movement of the driving rings 40, 41, 42, 43 is applied via connecting piece 21 as a rotational movement as indicated via arrow m2 to the lever 20 of each vane 10, 11, . . . . Thus the original movement of the ram drive 60 results in a rotation of vanes 10, 11, . . . .

Figure 4:
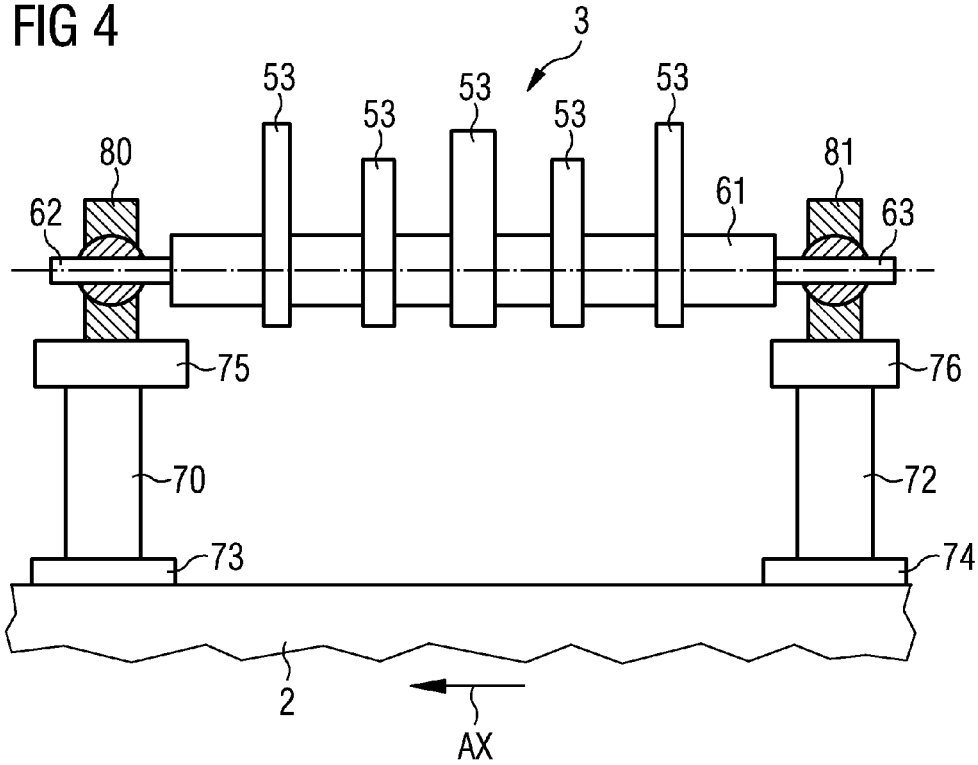
FIG. 4: is a view of device for adjusting pitch of variable guide vanes according to the invention.

FIGS. 3 and 4 illustrate a detail of the compressor 1, focussing on the rotatable shaft 61 and the way how it is mounted.

In FIG. 3 a rotatable shaft 61 is shown that is supported by a beam 90. The shaft 61 may have sections being cylindric—especially the section to which joints are connected at the first end 62 and at the second end 63 of the shaft 61—and other sections being in form of a cuboid. The beam 90 may be a cuboid and may provide the necessary support to the shaft 61.

Arms 53 attached to the shaft 61, preferably attached to the cuboid section of the shaft 61, distribute a rotational movement to the control rods 50 (not shown in FIG. 3). The shaft 61 is mounted with its first end 62 on a first joint 80 and with its second end 63 a second joint 81.

The joints 80, 81 are physically connected to the beam 90, e.g. connected to mounting welds at the end of the beam 90. At the same positions at which the joints 80, 81 are connected to the beam 90, also a connection to a first bracket 70 and a further bracket 71 is provided, that both again are connected to the casing 2 of the compressor 1.

The first bracket 70 is supposed to be fairly solid without allowing lateral adjustments of a first end of the bracket 70 in comparison to the second end of the bracket 70. In contrast to that the further bracket 71 is supposed to be flexible allowing lateral adjustments of a first end of the bracket 71 in comparison to the second end of the bracket 71. This permits that a thermal expansion of the casing 2 without a thermal expansion of the beam 90 or the shaft 61 will not result in mechanical stress on the brackets 70, 71, the beam 90, and/or the shaft 61, which eventually would lead to failures.

According to FIG. 4, the invention is described in a modified embodiment of the one described referring to FIG. 3. According to FIG. 4 and in contrast to FIG. 3, a beam 90 is removed and further inventive adaptations are taken place.

As before, a shaft 61 with arms 53, mounted on a first joint 80 and a second joint 81 is provided. The previously said regarding these parts applies also to FIG. 4.

The joints 80, 81 both are a combination of a ball-joint and pin-joint to provide rotational movement and to allow axial adjustment in the axial direction AX, as indicated by an arrow. The first end 62 of the shaft 61 and the second end 63 of the shaft 61 both—but at least one of them—do not provide a feature that would limit adjustments between the end 62, 63 of the shaft 61 and the joints 80, 81 in the axial direction AX.

A first end 73 of a first bracket 70 is connected to the casing 2 of the compressor. A second end 75 of the first bracket 70 is connected to the first joint 80. A similar connection is provided for a second bracket 72, i.e. a first end 74 of the second bracket 72 is connected to the casing 2 of the compressor and a second end 76 of the second bracket 72 is connected to the second joint 81. All these connection may preferably be arranged by bolts (not shown in the figure). As an alternative of having separate parts connected via bolts, also some of the mentioned components can be single components manufactured as one single piece, so that bolting is superfluous. Thus the first joint 80 may be integrated into the first bracket 70, the second joint 81 may be integrated into the second bracket 72.

Both brackets 70, 72 are designed to be rigid. The casing 2 of the compressor is also of a rugged design so that the brackets 70, 72 together with the casing 2 provide a reliable mounting for the shaft 61.

Furthermore, if the casing 2 will expand during operation due to thermal expansion, the brackets 70, 72 will increase its distance to each other in axial direction AX, without bending of one of the brackets 70, 72.

To compensate forces that could affect the brackets 70, 72 due to the thermal expansion of the casing 2, the first joint 80 provides adjustable positioning of a first end 62 of the shaft 61 and the second joint 81 fixed to a second end 76 of the second bracket 72 and providing adjustable positioning of a second end 63 of the shaft 61. This adjustable positioning is realised by the pin-joint within the joints 80, 81. The thermal expansion of casing 2 then leads to a further distance of the brackets 70, 72 to each other and leads to a different positioning of the joints 80, 81 at the shaft 61. A sliding mechanism is realised.

This sliding principle, as explained in regards of thermal expansion, together with the ball-joint, also compensates misaligned brackets 70, 72 and compensates positional tolerances of the brackets 70, 72 caused during manufacturing or assembly.

This sliding mechanism allows using very stiff brackets 70, 72, possibly manufactured by casting. Welding can be avoided, which might be a reason for material fatigue.

In reference to FIG. 5 two versions are shown how the device 3 for adjusting variable guide vanes may accommodate thermal expansion. The embodiments of FIG. 5 may be seen as optional because once assembled, the device 3 may have enough stability due to connection to the driving rings 40, 41, 42, 43 via the control rods 50 and the arms 53. On the other hand the embodiments of FIG. 5 may be advantageous in some situations and allowing easier assembly.

Figure 5A:
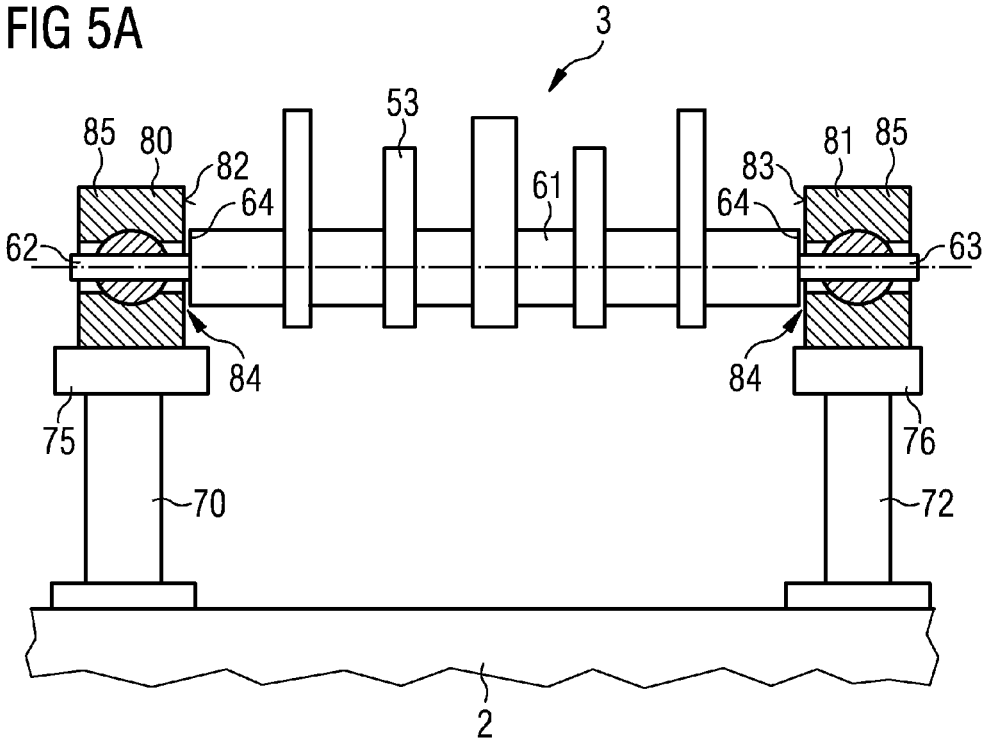
FIG. 5: are two further views of device for adjusting pitch of variable guide vanes according to the invention, especially focusing on the interaction of the joints and the shaft.

In FIG. 5A the first joint 80 has a joint housing 85 that surrounds the moving parts of the first joint 80. The joint housing 85 of the first joint 80 has a first side surface 82 directed to the central section of the shaft 61 with the arms 53. Similarly, the second joint 81 has a joint housing 85 that surrounds the moving parts of the second joint 81. The joint housing 85 of the second joint 81 has a second side surface 83 directed to the central section of the shaft 61 with the arms 53.

On both sides, the shaft 61 has a shaft shoulder 64 which could be seen as an interface between the central section of the shaft 61 with the arms 53 and the ends 62, 63 of the shaft 61. The shoulder 64 is defined such that it may touch one of the side surfaces 82, 83 of the joint housing 85 of the joints 80, 81. Advantageously the device 3 may be configured such that a gap 84 may be present as clearance between the first side surface 82 and the shaft shoulder 64 and/or between the second side surface 83 and the shaft shoulder 64.

No further restraining feature is present that would limit the shaft in its position besides the shaft shoulder 64.

As a result shaft is only limited in axial position by butting up to either of the joint housings 85, which again are fixedly connected to the brackets 70, 72.

Thus, also depending on the ambient temperature and the temperature of the casing 2, there is a clearance which allows a small amount of axial movement of the shaft 61, such that there is a small clearance when assembled, and a larger clearance when running, due to thermal expansion of the casing 2.

Figure 5B:
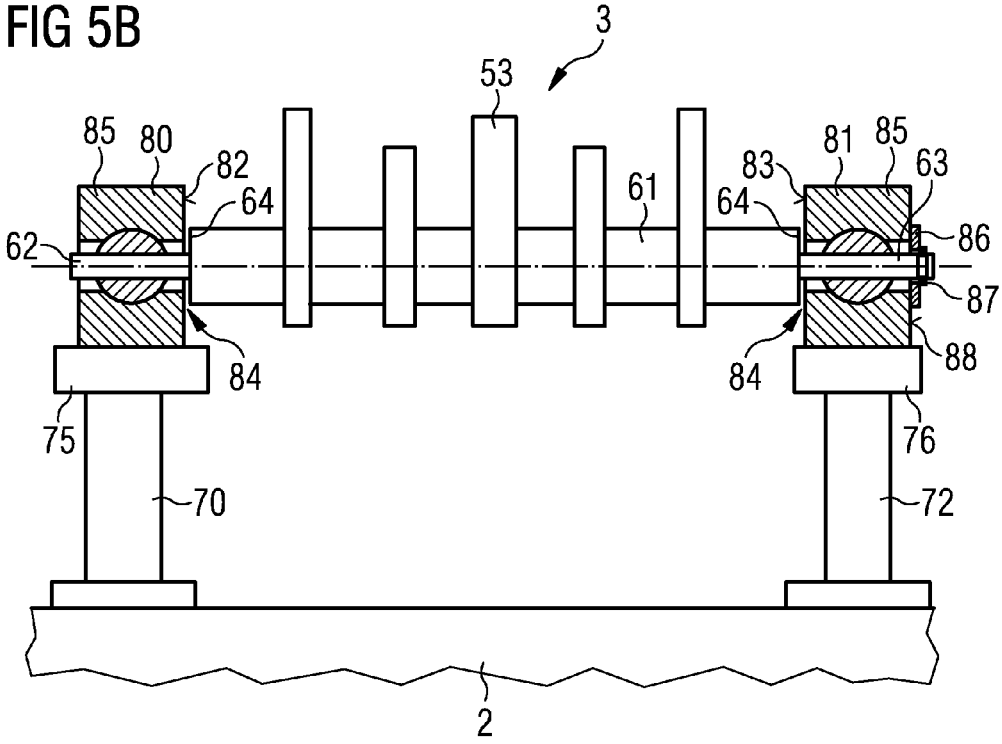

FIG. 5B shows a different solution having a feature that further limits axial movements of the shaft 61. In this embodiment a washer 86 and a circlip 87 is used as an example to have provide a limitation of axial movements. The washer 86 may be in contact with a third side surface 88 of the joint housing 85 of the second joint 81, the third side surface 88 being opposite to the second side surface 83 and facing axially to the final end of the shaft 61. Possibly a small gap 84 may be allowed to be present between the second side surface 83 and the shaft shoulder 64 and/or between the third side surface 88 and the washer 86. The washer 86 may be fixed on the second end 63 of the shaft via the circlip 87.

Such a construction may only be present at one end of the shaft 61, but possibly also both ends 62, 63 may be equipped with a washer 86 and a circlip 87, as long as thermal expansion of the casing 2 is considered.

The washer 86 and circlip 87 are only examples and different embodiments are possible, as long as opposite sides of one of the joint housings 85 is abutted.

Even though the gap 84 at the first joint 80 is drawn with a similar small gap as in FIG. 5A, it has to be noted that in FIG. 5B this gap 84 may be larger because the shaft 61 is already positioned via the washer 86 and circlip 87 at the second joint 81 and no further feature is necessary to limit axial movements of the shaft 61. Furthermore, in the embodiment of FIG. 5B a shoulder 64 opposing the first joint 80 may not even be necessary.

The advantages of the embodiments of FIGS. 5A and 5B are similar, as both allow thermal expansion of the casing 2 of the compressor without resulting in mechanical stress at the brackets 70, 72, the joints 80, 81 or the shaft 61. This is realised due to the possibility that at least one end of the shaft 61 allows axial movement within the joint 80 or 81.

To summarise the invention in the following paragraphs in reference to the prior art, it has to be noted that existing solutions may use a welded fabrication, incorporating a longitudinal beam with mountings welded at the ends. Such one-piece construction may cause manufacturing difficulty and cost in having to align with casing mounting holes at both ends. The welded construction typically is expensive, both in manufacture and in inspection. The welds are subject to fatigue failure in service. This one-piece design results in the need that relative thermal expansion of the casing has to be accommodated, which is done by flexing of the bracket.

According to the invention, such a longitudinal beam as known from the prior art is not necessary. Two brackets are bolted individually to the casing. During assembly, the two mountings do not need to be aligned simultaneously, which makes assembly easier. The casing provides sufficient support without the need for the additional longitudinal beam. This is therefore easier and cheaper to manufacture. Further, brackets may be cast and a welded fabrication may be avoided. This is made feasible by the fact of having two separate brackets, not connected via the beam. These cast brackets are cheaper to make. A further advantage of the cast brackets is that they can be made thicker, in order to reduce stress, with a very small cost penalty. The cost penalty for increasing the thickness of a fabricated bracket is much greater. The absence of welds in the cast brackets removes a potential cause of fatigue failure, and removes the cost of having to ensure weld quality.

The distribution shaft bearings with respect to each other are located by means of bolted interfaces to the casing, rather than by means of an interconnecting beam. The additional positional tolerances that are introduced by this indirect location are able to be absorbed by the combination of a ball-joint with a sliding pin joint at each end of the distribution shaft. The thermal expansion of the casing is accommodated by the shaft sliding in the pin joints.

The invention claimed is:

1. A device for adjusting variable guide vanes of an axial-flow machine, comprising:

at least one control rod for adjusting an angular position of the variable guide vanes;

a rotatable shaft to which the at least one control rod is pivotably connected;

a first bracket and a second bracket, each having a first end connectable to a casing of the axial-flow machine;

a first joint fixed to a second end of the first bracket and providing adjustable positioning of a first end of the shaft;

a second joint fixed to a second end of the second bracket and providing adjustable positioning of a second end of the shaft;

wherein the first joint and the second joint are spatially positioned to each other solely via a first fixed connection between the first end of the first bracket to the casing of the axial-flow machine and via a second fixed connection between the first end of the second bracket to the casing of the axial-flow machine, and wherein each one of the first joint and the second joint is a combination of a ball-joint and a sliding pin-joint, and wherein for each one of the first joint and the second joint the shaft represents a pin of the sliding pin-joint, which pin slides in a ball of the ball-joint during an axial adjustment in an axial direction, wherein the adjustable positioning of the ends of the shaft is realized by the first joint and the second joint such that both the first end of the shaft and the second end of the shaft are arranged without a restraining device terminating the shaft on an of the ends wherein the restraining device limits movements of the shaft in an axial direction of the shaft.

2. The device for adjusting variable guide vanes according to claim 1, wherein the first joint and the second joint are spaced apart via the first bracket, the casing and the second bracket, without a stabilising beam for interconnecting the first joint and the second joint.

3. The device for adjusting variable guide vanes according to claim 1, wherein the first bracket and/or the second bracket are cast.

4. The device for adjusting variable guide vanes according to claim 1, wherein the first bracket and/or the second bracket are inflexible such that lateral movements of the first end of the respective bracket in regards to the second end of the respective bracket is prohibited.

5. The device for adjusting variable guide vanes according to claim 1, wherein the connection of the first end of the first bracket and/or the first end of the second bracket to the casing is realized by bolting.

6. A compressor, comprising:

a device for adjusting variable guide vanes according to claim 1.

7. A gas turbine engine, comprising:

a compressor according to claim 6.

* * * * *